US005383432A

United States Patent [19]

Cullen et al.

[11] Patent Number: 5,383,432

[45] Date of Patent: Jan. 24, 1995

[54] METHOD AND APPARATUS FOR CONTROLLING IGNITION TIMING BASED ON FUEL-AIR COMPOSITION DURING FUEL EXCURSIONS

[75] Inventors: Michael J. Cullen, Northville; Thomas S. Gee, Canton; Thomas A. Schubert, Novi; Ross D. Pursifull, Dearborn; Allan J. Kotwicki, Sterling Heights, all of Mich.

[73] Assignee: Ford Motor Company, Dearborn, Mich.

[21] Appl. No.: 88,295

[22] Filed: Jul. 6, 1993

[51] Int. Cl.[6] ..... F02M 7/00

[52] U.S. Cl. ..... 123/406; 123/416; 123/417

[58] Field of Search ..... 123/406, 426, 416, 417

[56] References Cited

U.S. PATENT DOCUMENTS 4,584,978 4/1986 Sasaki et al. ..... 123/417
4,587,938 5/1986 Kobayashi et al. ..... 123/416
4,715,340 12/1987 Cook et al. ..... 123/406
4,854,286 8/1989 Chemnitzer ..... 123/406
4,942,860 7/1990 Chujo et al. ..... 123/417
5,101,787 4/1992 Kako ..... 123/417
5,213,178 5/1993 Polidan et al. ..... 123/417

*Primary Examiner*—Raymond A. Nelli
*Attorney, Agent, or Firm*—Roger L. May; Peter Abolins

[57] ABSTRACT

Method and apparatus for controlling ignition timing during alternating rich and lean fuel-air composition excursions for efficiency and for controlling torque fluctuations associated with the excursions. The method, for use in a vehicle having an internal combustion engine including an electronic fuel and spark control module, includes reducing spark advance instantaneously during a rich fuel-air excursion, and increasing spark advance during a lean fuel-air excursion. The amount of spark advance adjustment is preferably determined utilizing nonlinear functions which relate spark, torque ratios, and air-fuel ratios.

18 Claims, 8 Drawing Sheets

METHOD AND APPARATUS FOR CONTROLLING IGNITION TIMING BASED ON FUEL-AIR COMPOSITION DURING FUEL EXCURSIONS

TECHNICAL FIELD

The present invention relates to controlling ignition timing based on fuel-air composition.

BACKGROUND ART

As is known, early internal combustion engines were controlled to operate while holding fuel-air composition generally constant. Thereafter, oscillatory exhaust gas oxygen (EGO) sensor based fuel control systems were developed, and fuel-air composition could be varied but with resultant torque fluctuations and decreased fuel efficiency.

As part of the California Air Resources Board (CARB) On-Board Diagnostics (OBD-II) regulations, the capability for on-board monitoring of various vehicle sensors, such as the exhaust gas oxygen (EGO) sensor, must be provided by vehicle manufactures beginning with the 1994 model year. Typically, testing is completed during certain steady-state operating conditions which occur during normal vehicle operation. During testing, the vehicle electronic control unit enters a fuel control mode, the duration of which is about 10 seconds long. During this fuel control mode, the control unit alternates the air-fuel ratio between a "rich" ratio and a "lean" ratio at a frequency greater than 1.5 Hz. If the EGO sensor output does not properly respond to the varying A/F ratio, an indicator such as a warning light is energized, notifying the vehicle operator of the problem.

With engine load, engine speed and ignition (spark) timing held relatively constant, engine torque varies with the air-fuel ratio. Air-fuel ratios slightly richer than stoichiometry produce more torque than air-fuel ratios slightly leaner than stoichiometry. As a result, the air-fuel modulations, such as those necessary for the OBD-II test strategy or for oscillatory fuel control, can cause engine torque fluctuations during the test sequence. These torque fluctuations result in engine surges felt by the vehicle operator, thereby affecting driveability.

On multi-bank engine configurations, e.g. V6 and V8 engines with each bank having its own EGO sensor, this problem can be solved by utilizing 180° phasing of the air-fuel modulation between the banks, especially where each bank has an associated catalyst. For example, one bank of the "V" is forced rich, while the other bank is forced lean. The torque increase associated with the rich ratio is in effect canceled by the torque decrease associated with lean ratio. This 180° phasing, however, is not possible on single bank engine configurations, e.g. inline 4- and 6-cylinder engines having a single EGO sensor.

Present practice in electronic engine controllers sets ignition timing based on several factors such as engine speed, intake manifold pressure, average fuel-air composition, and operating temperature, and varies fuel-air composition around stoichiometry. Although there is an ignition timing setting that optimizes engine torque output and hence fuel efficiency, present practice does not control ignition timing as a function of instantaneous fuel-air composition. For purposes of this discussion, fuel-air composition is considered to be a dimensionless measure of the proportional composition of fuel and air in an assumed homogeneous volume. It is often summarized by one of the following quantities: air-fuel ratio, fuel-air ratio, relative air-fuel ratio ($\lambda$), equivalence ratio ($F_R$), and redox potential.

Accordingly, it is desirable to develop an engine control strategy for controlling torque fluctuations during forced fuel excursions, especially on single sensor engine configurations. It is also desirable to develop an engine control strategy for controlling ignition timing based on instantaneous fuel-air composition to achieve optimum engine performance.

SUMMARY OF THE INVENTION

It is therefore an object of the present invention to provide a method and apparatus for instantaneously controlling ignition timing based on fuel-air composition during fuel excursions for increasing engine efficiency or improving vehicle driveability.

It is a further object of the present invention to provide a method and apparatus for controlling torque fluctuations during fuel excursions on an engine with a single EGO sensor.

In carrying out the above objects and other objects and features of the present invention, there is provided a method, for use in a vehicle having an internal combustion engine including an electronic fuel and spark control module, for controlling ignition timing during alternating rich and lean excursions of fuel-air composition. The method comprises reducing spark advance instantaneously during a rich fuel-air composition excursion; and increasing spark advance instantaneously during a lean fuel-air composition excursion. The spark advance is reduced and increased such that the engine is controlled to obtain at least one of improved engine efficiency or improved vehicle driveability by reducing engine torque fluctuations associated with the alternating rich and lean fuel-air composition excursions. In the preferred embodiment, the amount of spark advance adjustment is determined utilizing nonlinear functions which relate torque ratios, air-fuel ratios and spark advance.

Apparatus are also provided for carrying out the methods.

The advantages accruing to the present invention are numerous. For example, by strategically controlling spark advance, optimum engine performance can be attained, and torque fluctuations during fuel excursions are substantially eliminated without significantly affecting emissions, thereby improving driveability of the single engine bank vehicle during, for example, OBD-II test sequences.

The above objects and other objects and features of the present invention will be readily appreciated by one of ordinary skill in the art from the following detailed description of the best mode for carrying out the invention when taken in conjunction with the following drawing figures.

BEST MODE FOR CARRYING OUT THE INVENTION

Figure 1:
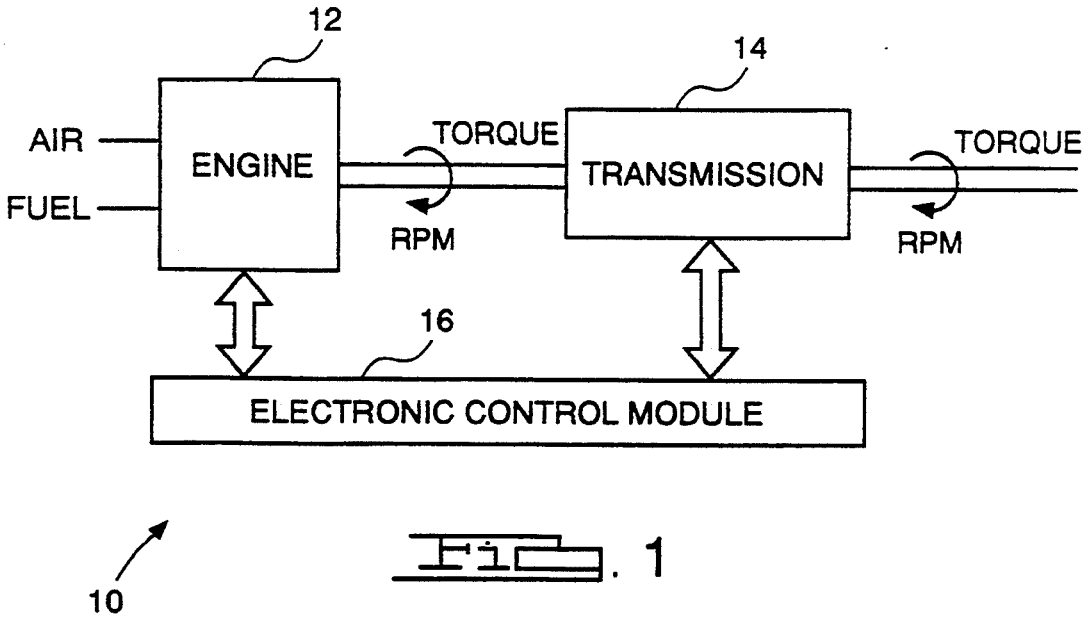
FIG. 1 is a block diagram of a controller for use with the present invention.

Referring now to FIG. 1, air and fuel are supplied to an engine 12, which has a speed (RPM) output and a torque output applied to a transmission 14. The engine 12 and the transmission 14 are coupled to an electronic control module (ECM) 16. In the preferred embodiment, the engine 12 is a single bank engine, i.e. a four-cylinder engine or an in-line 6-cylinder engine. For purposes of this discussion as it relates to OBD-II test sequences, any group of cylinders which share an oxygen sensor could be treated as a bank. Preferably, the control module 16 receives data relating to operation of the engine 12 and the transmission 14 from a plurality of sensors not specifically illustrated for the sake of clarity. For example, engine 12 typically includes sensors for measuring exhaust gas oxygen, engine speed, temperature and mass air flow, just to name a few. With this data, the ECM 16 accordingly executes an engine operation control strategy, which includes the torque fluctuation control strategy of the present invention.

The control strategy of the present invention is executed as a means of compliance with the OBD-II regulations. Of course, it should be noted that there are many reasons for fuel-air excursions other than EGO sensor testing and many other sources of torque fluctuations during engine control, and the control strategy of the present invention is equally applicable to those. Those regulations, as is known to one of ordinary skill in this art, requires testing of the operating condition of the exhaust gas oxygen sensor. More specifically, the OBD-II test sequence consists of imposing multiple alternating forced fuel excursions on the engine, thereby imposing alternating "rich" and "lean" air-fuel ratios.

Figure 2A:
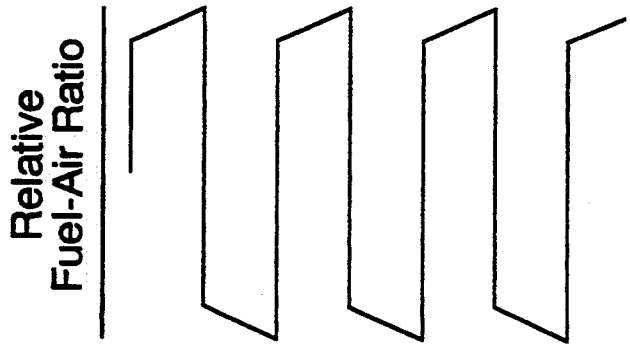
FIGS. 2*a*–2*c* are a graphical illustration of relative fuel-air ratio, ignition timing and net engine torque without timing modulation.
Figure 2B:
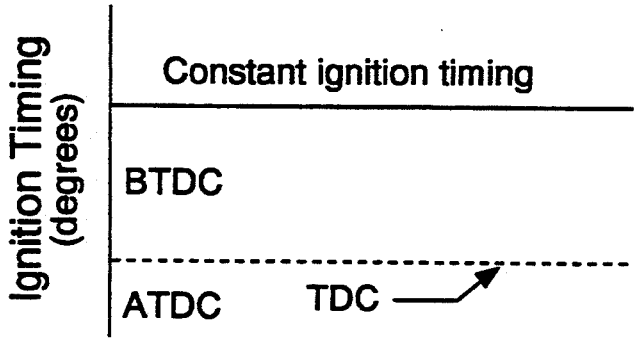
Figure 2C:
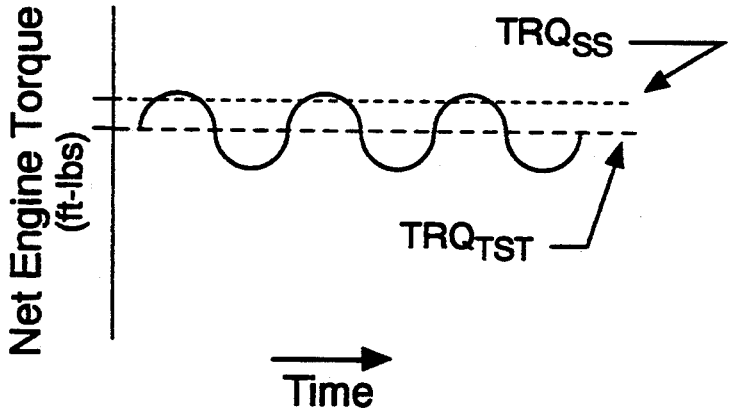

Referring now to FIGS. 2*a*–2*c*, three graphs illustrate the effect of the forced fuel excursions on net engine torque. The fuel injectors are preferably operated according to the relative fuel-air ratio waveform shown. This waveform is obtained from a closed-loop air-fuel modulation scheme described in greater detail in U.S. patent application Ser. No. 08/088,296, filed herewith and titled "Air-fuel Modulation For Oxygen Sensor Monitoring", the specification of which is hereby expressly incorporated by reference in its entirety. It should be appreciated that by varying the relative fuel-air ratio as shown, the ratio alternates between a rich ratio and a lean ratio. In the preferred embodiment, the ratio is alternated at a frequency of between 1.5 Hz and 2 Hz.

With continuing reference to FIGS. 2*a*–2*c*, one approach is to apply the fuel pulse width waveform to the fuel injectors while maintaining relatively constant ignition timing (i.e. spark advance) set at a certain number of degrees before top dead center (BTDC). With engine load, engine speed and ignition timing or spark held relatively constant, engine torque varies with the fuel-air composition. Fuel-air compositions richer than stoichiometry produce more torque than those leaner than stoichiometry. The relatively high frequency modulations cause engine torque fluctuations during the test sequence, affecting driveability. As shown in FIG. 2*c*, the net torque, output from a single-bank engine utilizing fuel-air modulation with constant ignition timing, oscillates above and below average steady state engine torque during normal operation ($TRQ_{SS}$) and average torque during OBD-II testing ($TRQ_{TST}$).

Figure 3A:
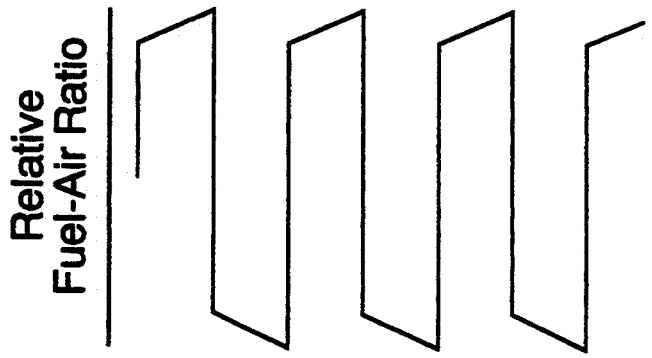
FIGS. 3*a*–3*c* are a graphical illustration of relative fuel-air ratio, ignition timing and net engine torque with timing modulation according to the present invention.
Figure 3B:
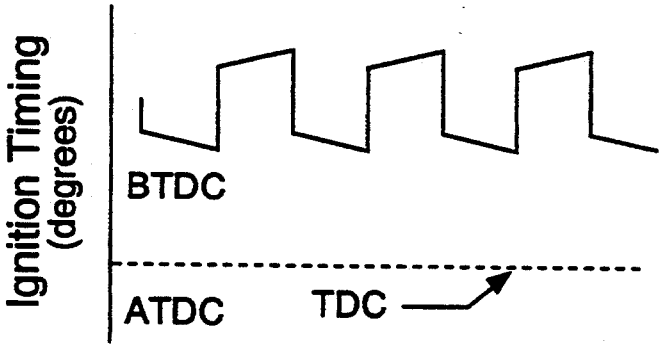
Figure 3C:
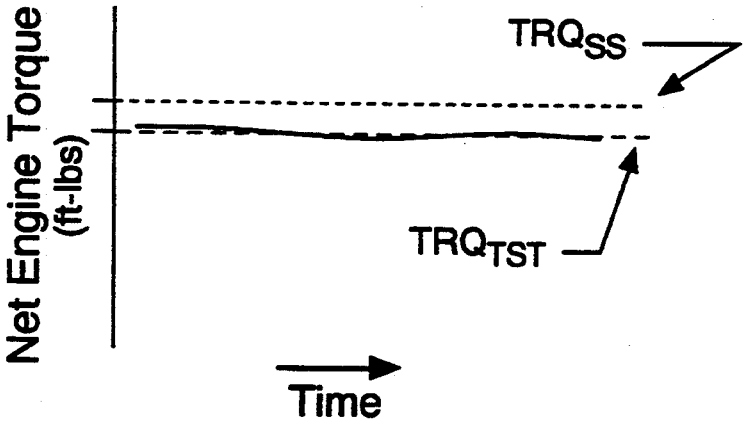

Referring now to FIGS. 3*a*–3*c*, three graphs similar to those of FIGS. 2*a*–2*c* illustrate the effect of the forced fuel excursions on net engine torque when the engine is controlled according to the present invention. The fuel injectors are preferably operated according to the fuel-air composition waveform shown, which, as discussed above, is obtained from a previously described closed-loop air-fuel modulation scheme.

According to the present invention, the 1.5 Hz to 2.0 Hz waveform is to be applied to the fuel injectors while simultaneously varying the ignition timing. More specifically, to compensate for the torque fluctuations during the fuel-air modulation, the ignition timing will be instantaneously retarded during rich excursions and then instantaneously advanced during lean excursions. As shown in FIG. 3*c*, the net torque, output from a single-bank engine utilizing fuel-air modulation with the preferred variable ignition timing, remains remarkably constant instead of oscillating above and below average steady state engine torque during normal operation ($TRQ_{SS}$) and average torque during OBD-II testing ($TRQ_{TST}$). Accordingly, the driver is not subjected to the lurching or surging feeling which accompanies the approach of FIGS. 2*a*–2*c*.

The following is a glossary of abbreviations for terms which appear throughout this disclosure:

| | |
|---|---|
| AMP_MULT = | a multiplier used to create a fuel-air composition waveform for oxygen sensor fault detection. Typical value = .1. |
| INV_ITQSPKMUL = | a table of values stored in a non-volatile memory which describes that amount of spark retard from MBT required for a given desired ratio of indicated torque at a particular spark advance to indicated torque at zero spark retard, or MBT. This is the negative inverse of ITQSPKMUL. Graphically shown in FIG. 5. |
| ITQUAFMUL = | a table of values stored in non-volatile memory which describes the ratio of indicated torque at a given LAMBSE, to the indicated torque at stoichiometric A/F (i.e. a LAMBSE of 1.0). |
| ITQLEAN = ITQAFMUL @ LAMLEAN | |

-continued

ITQRICH = ITQAFMUL @ LAMRICH

ITQROA = a non-volatile memory scalar equal to the required range of authority of indicated torque perturbations given the values LAMRICH and LAMLEAN. Assume that rich A/F is generally not richer than the lean ratio for best torque. This value is calculated off-board as a function of other values.

ITQROACUR = ITQAFMUL at current LAMBSE

ITQROASTEP = a scalar which indicates the step size of indicated torque in successive loops which a typical human driver cannot detect. Typical value = .005 (i.e. .5%).

ITQSPKMUL = a table of values stored in non-volatile memory which describes a ratio of torque at a particular spark advance and idnicated torque at MBT spark, to a given spark (i.e. distance from MBT spark). Graphically shown in FIG. 4.

LAMBSE = the desired air/fuel ratio divided by the stoichiometric air/fuel ratio (about 14.6:1 for U.S. gasoline).

LAM_MOD_FLG = a variable set to 1.0 when the vehicle is determined to be at a relatively steady-state condition where the OBD-II test can be run.

LAMLEAN = leanest A/F used during OBD-II test.

LAMRICH = richest A/F used during OBD-II test.

SAFTOT_NORM = the value of desired ignition timing for the current engine speed, LOAD (an indication of torque level of engine), LAMBSE, and other variables known to the control module, which would be used if not operating in $O_2$ sensor fault detection mode. For the example below, assume SAFTOT_NORM=20.

SPKDEL_NORM = $SPK_{MBT}$ - SAFTOT_NORM $SPK_{MBT}$ = the value of MBT spark for the current engine speed, LOAD, LAMBSE, and other variables known to the control module. For the example below, assume $SPK_{MBT}$=22.

Figure 4:
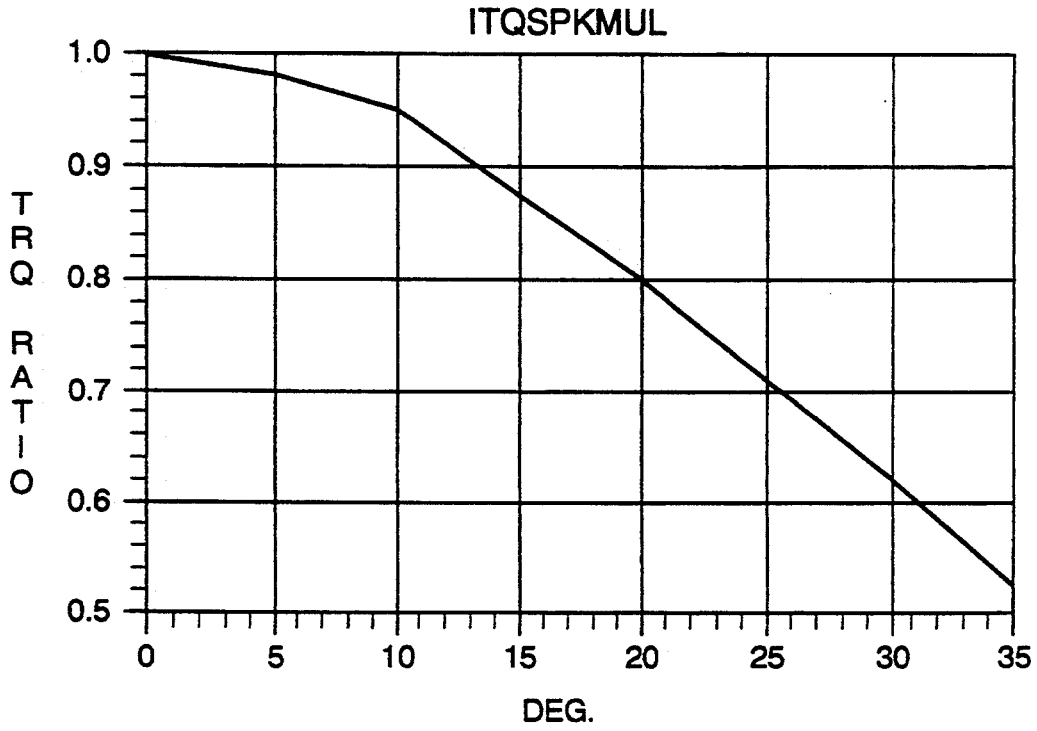
FIG. 4 is a graphical illustration of a function which relates spark offset from the value required for minimum spark advance for best torque (MBT) to a torque ratio.
Figure 5:
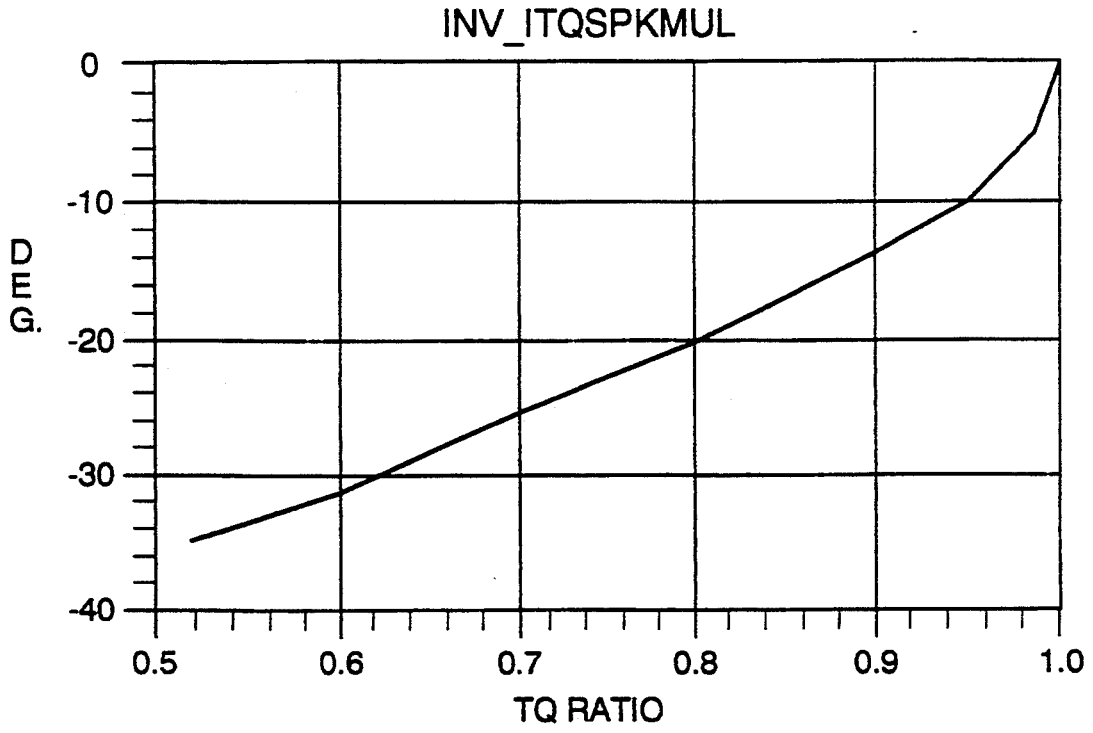
FIG. 5 is a graphical illustration of the negative inverse of the function shown in FIG. 4.

Referring now to FIGS. 4 and 5, the present invention preferably utilizes a pair of functions, labelled as ITQSPKMUL and INV_ITQSPKMUL, respectively, which relate a spark that is offset or retarded from MBT spark and a torque ratio. The existence of this kind of relationship allows the present invention to compensate for torque fluctuations imposed on the engine due to fuel excursions via a torque ratio-based calculation, which in turn allows a direct calculation of the required spark advance adjustment. It should be appreciated that the fuel excursions referred to herein include not only forced fuel excursion associated with OBD-II testing sequences, but could also include fuel excursions resulting from normal closed-loop engine control during vehicle operation.

Preferably, the strategy is based on actual mapping data obtained from a calibration procedure with the data being entered in Table I, shown below, which is preferably stored in a non-volatile memory (e.g. ROM or the like) of the ECM 16.

TABLE I

| DEG. | TORQUE RATIO |
|---|---|
| 0 | 1.00 |
| 2 | 0.995 |
| 5 | 0.990 |
| 8 | 0.980 |
| 10 | 0.960 |
| 13 | 0.935 |

TABLE I-continued

| DEG. | TORQUE RATIO |
|---|---|
| 15 | 0.910 |
| 20 | 0.840 |
| 26 | 0.700 |

With continuing reference to FIG. 4, the horizontal axis represents the amount the spark is retarded from MBT spark, measured in crankshaft degrees (°). The vertical axis represents the ratio of delivered engine torque at a particular spark advance to the engine torque delivered when the engine is operating at MBT spark. In other words, when the engine is operating at MBT spark, the torque ratio is 1.0 and when the operating point is retarded from MBT spark, the resulting torque ratio will be a dimensionless fractional value, such as 0.80 or 0.90.

The spark/torque function table values shown above in Table I were obtained from engine mapping data and represent typical numbers for a given engine design. To obtain these numbers, for example, an engine was operated at a desired engine speed and a particular air charge (i.e. load), and the spark advance was set at $SPK_{MBT}$. The brake torque and the friction torque were observed and recorded at these initial conditions. Next, the spark advance value was retarded by a predetermined amount ($SPK_X$), such as five degrees (5°), and the brake torque and the friction torque were observed and recorded again. This process was repeated a number of times, resulting in Table I.

It should be noted that the indicated torque is a combination of brake torque and friction torque. From the indicated torque values, the torque ratio TR can be calculated as follows:

$$TR = \frac{T @ SPK_X}{T @ SPK_{MBT}}$$

Referring now to FIG. 5, there is graphically illustrated another function, labelled as INV_ITQSPKMUL, which also relates spark and torque ratio. It can be seen that the function shown in FIG. 5 is a negative inverse of the function shown graphically in FIG. 4. Similarly, a table of values, shown below in Table II, which represents INV_ITQSPKMUL, is similarly stored in the non-volatile memory of the ECM 16:

TABLE II

| DEG. | TORQUE RATIO |
|---|---|
| 0 | 1.00 |
| −2 | 0.995 |
| −5 | 0.990 |
| −8 | 0.980 |
| −10 | 0.960 |
| −13 | 0.935 |
| −15 | 0.910 |
| −20 | 0.840 |
| −26 | 0.700 |

Figure 6:
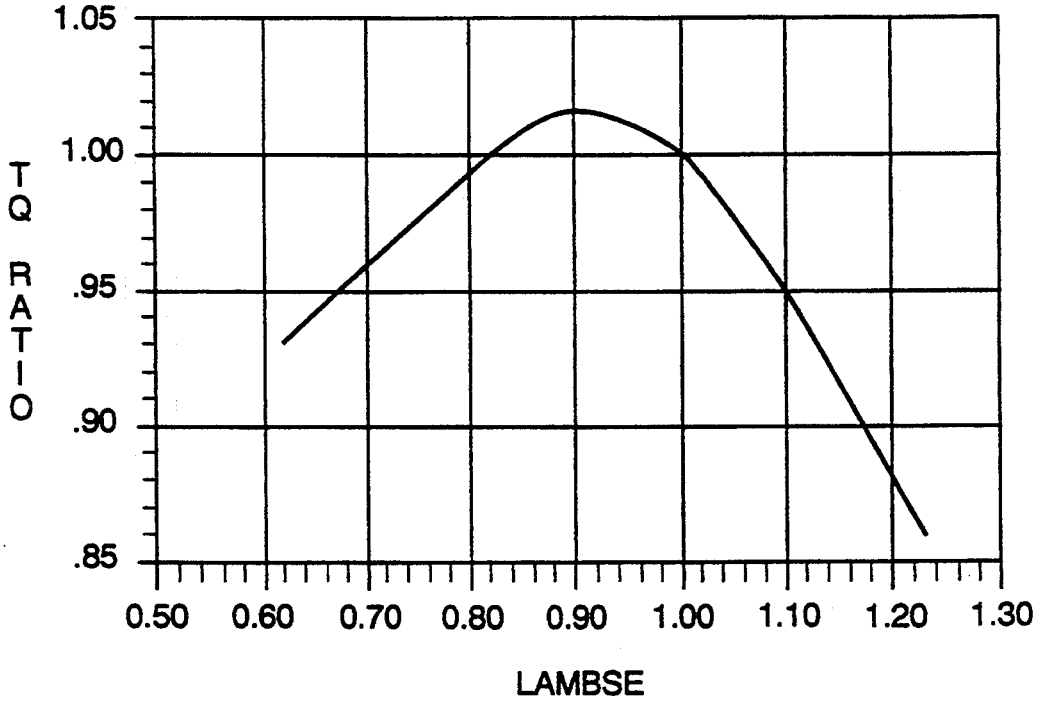
FIG. 6 is a graphical illustration of a function which relates indicated torque at a particular air/fuel ratio to the indicated torque at stoichiometric air-fuel.

Referring now to FIG. 6, there is graphically illustrated a function, labelled as ITQAFMUL, which relates indicated torque at a given LAMBSE to the indicated torque at stoichiometric air-fuel. A table of values, shown below as Table III, represents ITQAFMUL and is stored in non-volatile memory of the ECM 16:

TABLE III

| LAMBSE | TORQUE RATIO |
|---|---|
| 0.62 | 0.930 |
| 0.76 | 0.980 |
| 0.90 | 1.015 |
| 1.00 | 1.000 |
| 1.05 | 0.975 |
| 1.10 | 0.950 |
| 1.23 | 0.860 |

Figure 7:
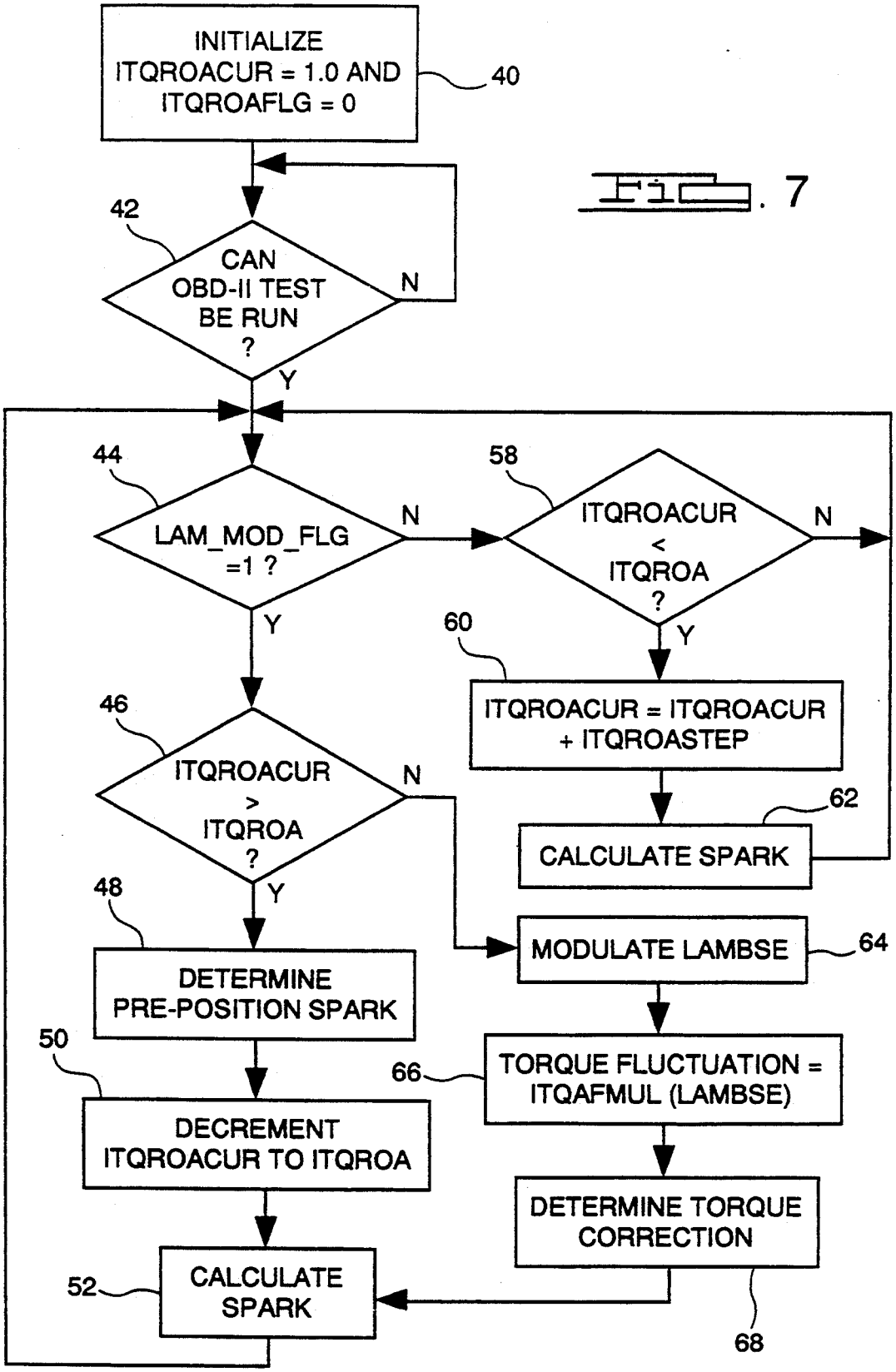
FIGS. 7 and 8 are flowcharts detailing a strategy for minimizing torque fluctuations according to the present invention.

With reference now to FIG. 7, there is shown a flowchart detailing the torque fluctuation control strategy of the present invention. At step 40, the ECM 16 initializes variables to predetermined values at engine start-up. At step 42, the ECM collects information from various sensors, such as the speed, load and temperature data, and determines whether or not the operating conditions of the engine are appropriate for EGO sensor fault detection according to OBD-II regulations. If conditions permit testing, the LAM_MOD_FLG is set to a value of 1.0.

With continuing reference to FIG. 7, at step 44 the ECM tests the value of the LAM_MOD_FLG. If the sensor test can be run (i.e. flag=1), at step 46 the ECM determines if the current value of intended torque range of authority (ITQROACUR) is greater than the ROM scalar ITQROA. An example of the determination of ITQROA is as follows:

| | |
|---|---|
| LAMRICH = 1 − AMP_MULT | [1.−.1=.9] |
| ITQRICH = ITQAFMUL(LAMRICH) | [1.015] |
| LAMLEAN = 1 + AMP_MULT | [1.+.1=1.1] |
| ITQLEAN = ITQAFMUL(LAMLEAN) | [.95] |
| ITQROA = 1−(ITQRICH−ITQLEAN) | [1−(1.015−.95)=.935] |

With continuing reference to FIG. 7, if ITQROACUR is greater than ITQROA, at step 48 the pre-position spark required is determined. Preferably, step 50 is repeated in quick succession, such that ITQROACUR is decremented by ITQROASTEP to ITQROA in a step size which cannot be noticed by the driver. This can be expressed algebraically as:

$$ITQROACUR = ITQROACUR - ITQROASTEP$$

Continuing the above example, after the first pass ITQROACUR would have a value of 1.0−0.005=0.995. This decrementing would continue until ITQROACUR has been decremented the value of ITQROA (i.e. 0.065). Thus, after the last pass ITQROACUR would have a value of 0.940−0.005=0.935.

At step 52 of FIG. 7, control flow jumps to a routine to calculate an appropriate spark advance adjustment. Step 52 is preferably performed in quick succession, allowing the pre-position spark to be blended or phased in gradually and unnoticed by the driver. Even though the torque delivered by the engine is decreased by each pre-position step, the reduction is slight and can be taken up by some other appropriate action, such as by modifying air charge. It should therefore be appreciated that this procedure provides a type of torque reserve from which further adjustments are made to actually reduce the torque fluctuations resulting from the forced fuel excursions.

Figure 8:
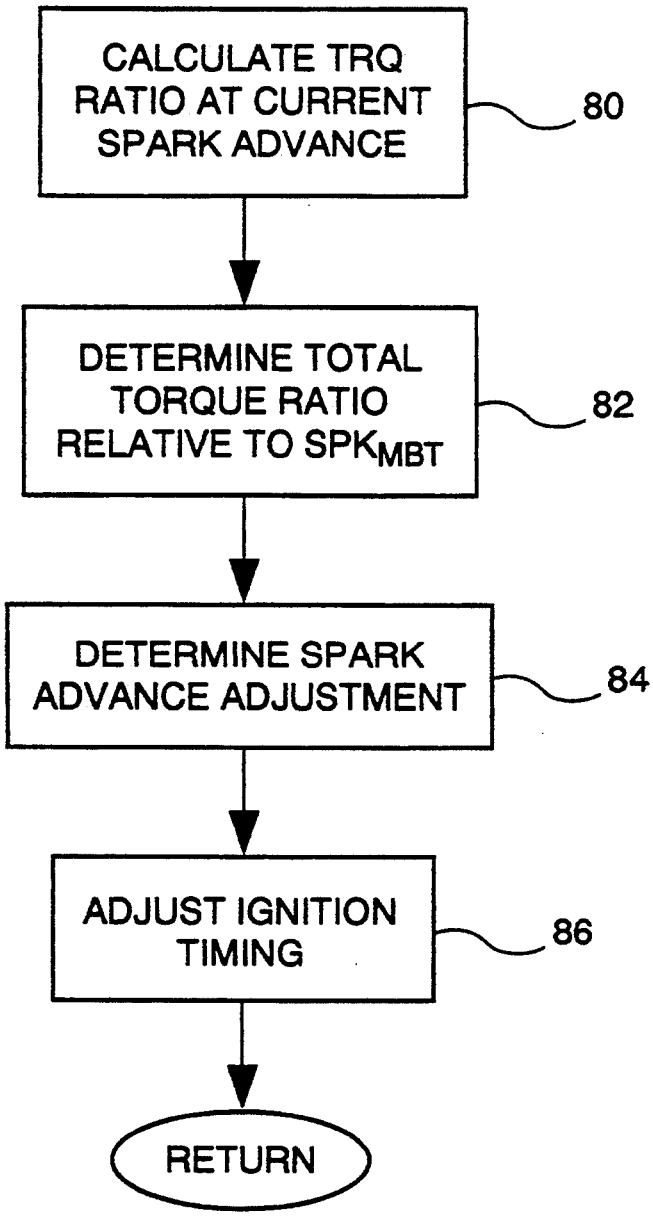

Referring now to FIG. 8, there is shown a flowchart detailing the steps of the calculate spark routine, which generates a spark advance adjustment. An input to this routine is represented by the variable ITQ_RATIO_REQ. If this variable has a value of 1.0, maximum torque is requested. Any value less than 1.0 is a request for partial torque via spark retard.

At step 80 of FIG. 8, the ECM 16 calculates the indicated torque ratio at current spark advance utilizing the ITQSPKMUL function of FIG. 4 as follows:

$$SPKDEL_NORM = SPK_{MBT} - SAFTOT_NORM$$

$$ITQSPKMUL_NORM = ITQSPKMUL(SPKDEL_NORM)$$

At step 82, the total torque ratio relative to $SPK_{MBT}$ is determined by subtracting the torque ratio requested from the indicated torque ratio at current spark advance:

$$ITQSPKMUL_TOT = ITQSPKMUL_NORM - ITQ_RATIO_REQ$$

At step 84, the ECM determines the extent of spark advance adjustment (i.e. the degrees of spark retard from $SPK_{MBT}$) corresponding to this total torque ratio by inputting ITQSPKMUL_TOT to the INV_ITQSPKMUL function shown in FIG. 4. Stated algebraically:

$$SPKDEL_TOT = ITQSPKMUL_INV(ITQSPKMUL_TOT)$$

All that remains is converting this adjustment to an actual spark advance:

$$SAFTOT = SPK_{MBT} + SPKDEL_TOT$$

and accordingly adjusting the ignition timing at step 86, thereby modifying the torque delivered by the engine.

With reference once again to FIG. 7, if the result of step 44 was negative, the OBD-II sensor test should not be performed and control flow would skip to step 58, wherein the ECM 16 would determine whether or not the current value of intended torque range of authority (ITQROACUR) is less than ITQROA. If it is, the spark will be blended back to a normal schedule. Accordingly, at step 60 the current value of the indicated torque range of authority is increased to ITQROA incrementally by an amount equal to the variable ITQROASTEP:

$$ITQROACUR = ITQROACUR + ITQROASTEP$$

This procedure too is preferably performed continuously so that the spark modification goes largely unnoticed by the vehicle operator. At step 62, the calculate spark routine of FIG. 8 is invoked and carried out as described in greater detail above to determine the actual ignition timing adjustment. In this case, the input to the calculate spark routine (ITQ_RATIO_REQ) has the value of ITQROACUR.

As shown in FIG. 7, if the results of the comparison of step 46 were negative, control flow jumps to step 64, wherein the ECM performs the OBD-II test and, therefore, begins the forced fuel excursions. It is at this time that the fuel-air composition shown in FIG. 3*a* is generated and applied to the fuel injectors to detect a failed $O_2$ sensor.

The implementation of this fuel injector pulse width results in alternating rich and lean air-fuel ratio excursions which, in turn, results in perturbations in LAMBSE, since its value is based on the air-fuel ratio. For any given LAMBSE, the ignition timing is to be adjusted to cancel the change in indicated torque. As an example, assume LAMBSE=1.05 and SAFTOT=9. At step 66, the expected change in indicated torque due to LAMBSE is expressed algebraically as:

ITQAFMUL=ITQAFMUL(LAMBSE)

Thus, ITQAFMUL(1.05)=0.975, as shown in Table III above and FIG. 6. At step 68, the required torque correction expressed as a ratio is determined:

ITQSPKMUL=[1/ITQAFMUL]*ITQROA

Continuing the example, the required torque correction is [1/0.975]*0.935=0.958. Control flow then jumps to step 52, wherein the calculate spark routine of FIG. 8 is invoked. In this case, the input to the calculate spark routine (ITQ_RATIO_REQ) is assigned the value of 0.958.

Figure 9A:
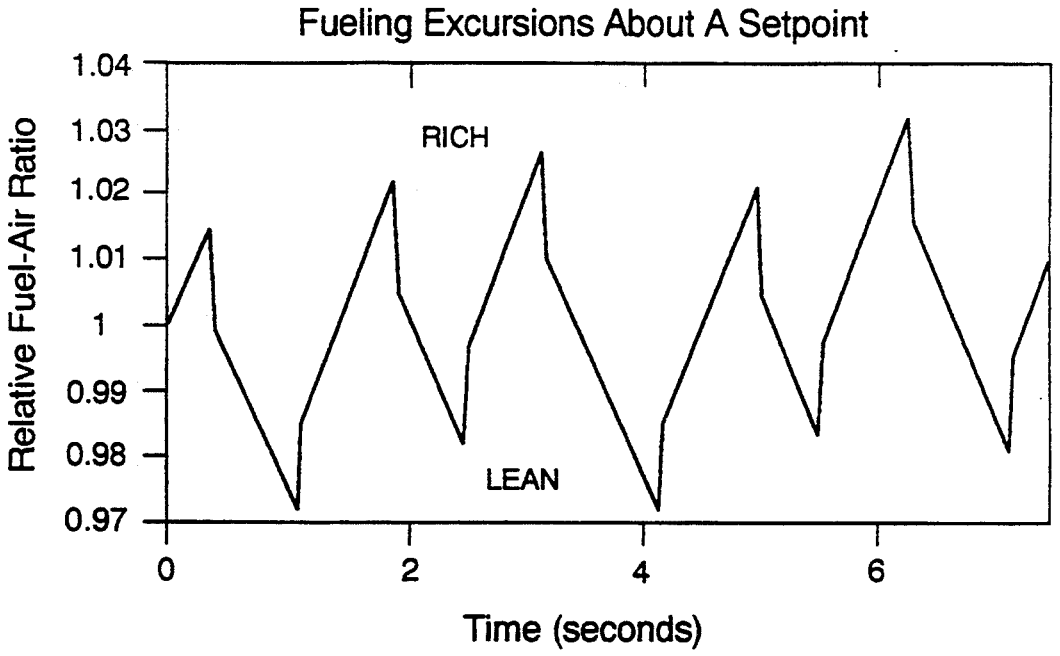
FIGS. 9*a* and 9*b* are illustrations of relative fuel-air ratio (fueling excursions) and the associated spark adjust based on the relative fuel-air ratio, respectively.
Figure 9B:
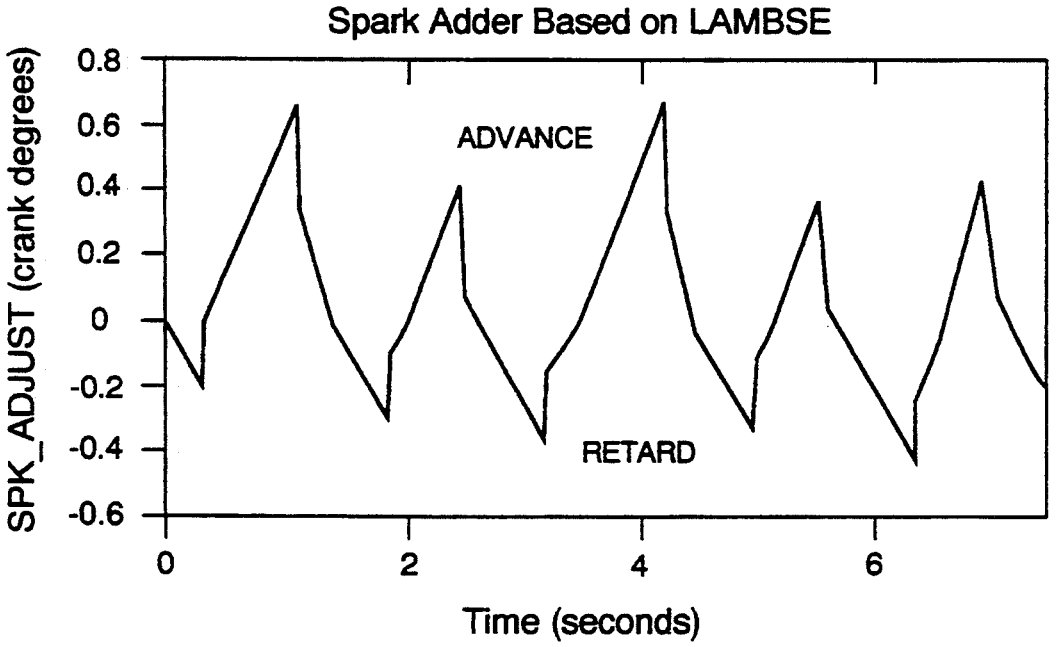

In another embodiment of the present invention, it was recognized that optimum ignition timing depends on fuel-air composition, and setting ignition timing according to this optimum relationship would achieve optimum engine performance. Thus, in this embodiment, ignition timing is controlled based not on average fuel-air composition as in the prior art, but on instantaneous fuel-air ratio so as to achieve increased torque output and more stable torque as compared to ignition timing controlled based on average fuel-air composition. As an example, consider a fuel control system which varies fuel-air composition with a ramp-jump-back wave modulation amplitude ±5% of the stoichiometric fuel rate. If other factors that affect optimum ignition timing are held generally constant, optimum ignition timing would vary with the same periodicity as fuel rate. Therefore, appropriately varying ignition timing with this periodicity would optimize engine performance and lower torque fluctuations. This concept is shown in FIGS. 9*a* and 9*b*, which illustrate the ignition control strategy of the present invention and the relation between fueling excursions and spark adjust.

As an example implementation, consider that fuel injected and air inducted through the intake port results in an intended fuel-air composition, having one ratio, being trapped in the cylinder. Residual gas, having another ratio, is mixed with this fresh charge. For purposes of this discussion, reference is made to the fresh charge composition, not the composition of mixed fresh and residual charge. One could estimate the actual fresh charge fuel-air composition and it would in general be different than intended fuel-air composition. For simplicity, the present invention utilizes the intended fuel-air composition (LAMBSE) as the best estimate of the actual fuel-air composition. One advantage of utilizing the intended fuel-air composition is that effects known as transient/dynamic fuel compensation are generally ignored.

Figure 10:
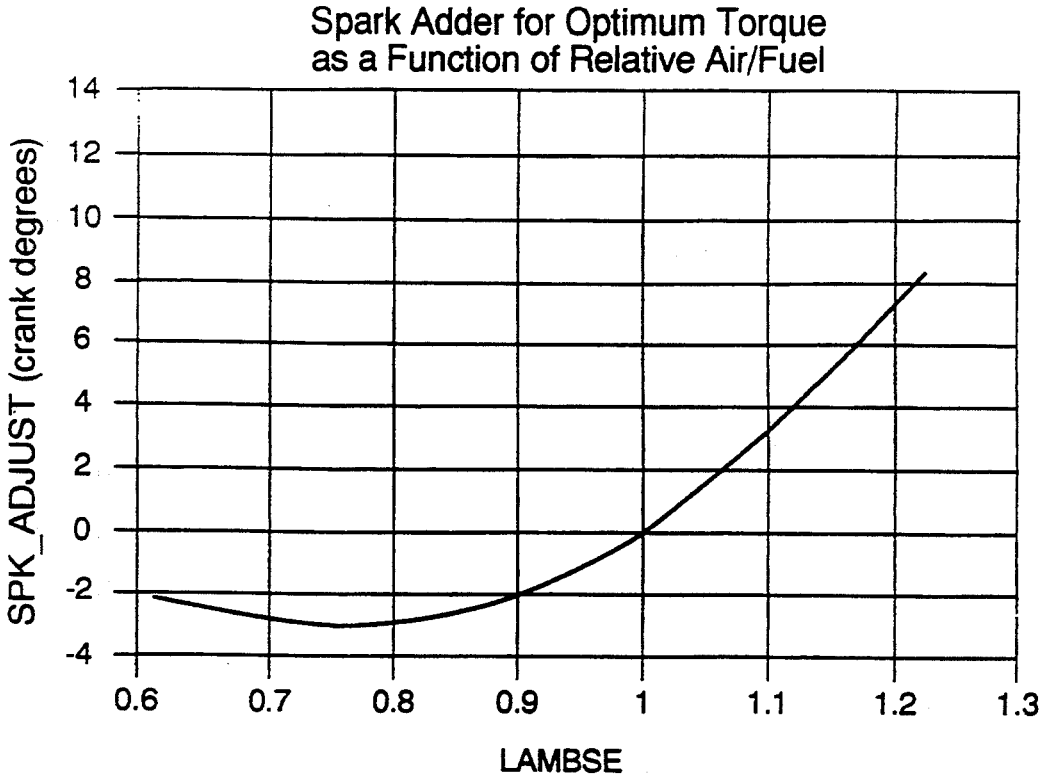
FIG. 10 is a graphical illustration of a function which relates a spark adjust to relative air-fuel ratio (LAMBSE)

Restated mathematically, $$SAF := SAF_{stoich} + f_a(LAMBSE)$$

wherein SAF=ignition timing and $f_a$ is a function for determining spark adder (SPARK_ADJUST) based on LAMBSE (i.e. intended relative air-fuel ratio). That is, function $f_a$ would relate MBT spark to intended fuel-air composition, as shown in FIG. 10. Since the data shown in FIG. 10 was taken at MBT ignition timing, it is most applicable at engine operating points where ignition timing is at MBT. However, littler error is caused by using this relationship away from MBT. Should it be deemed significant, FIG. 10 could be expanded to a table, 3D surface, or family of curves having the additional input variable of average ignition timing relative to MBT. As shown in FIG. 10, the general rule is rich-retard, lean-advance. However, at some points, this rule does not always hold true.

To enforce the optimal relationship between ignition timing and fuel-air composition, SAF and LAMBSE are ideally in phase and aligned to operate on the same cylinder and cylinder event, although it is recognized that these controls may not be cylinder specific nor cylinder-event specific. Partial benefit will be able to be obtained utilizing SAF and LAMBSE as is. To achieve full benefit, the LAMBSE command (i.e. intended fuel-air composition) and the SAF command (i.e. ignition timing) would be coordinated on a cylinder-to-cylinder basis and a cylinder-event-to-cylinder-event basis.

Figure 11:
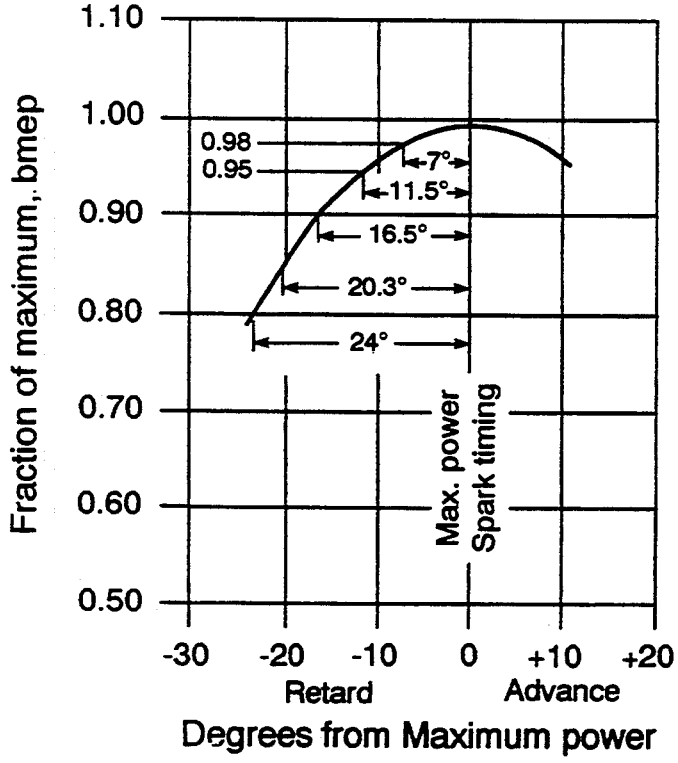
FIG. 11 is graphical illustration of performance loss as ignition timing is adjusted from minimum spark advance for best torque.

Referring now to FIG. 11, there is shown a graph illustrating performance loss as ignition timing is adjusted away from MBT spark. To project the benefit derived from the methodology of the present invention, consider FIG. 10 to identify where on the efficiency versus ignition timing curve an engine is operating and where the engine could be operated if the methodology was implemented. Where optimum ignition timing is governed by knock or $NO_x$ limits, the present invention would have less spark scatter relative to MBT and thus allow the engine to be operated closer to the knock or $NO_x$ limit (that ignition timing where if further advanced, $NO_x$production would exceed an acceptable amount).

As shown in FIG. 11, this graph indicates that if ignition timing is retarded 7° from MBT there is about a 2% efficiency loss, whereas if the ignition timing is retarded 11.5° from MBT there is about a 5% efficiency loss. Qualitatively, the methodology proposed would effectively operate higher on this efficiency curve than present practice, thus delivering higher engine efficiency. Mapping tests, such as FIG. 10, could be utilized to quantify the benefit and/or calibrate the function that describes MBT sensitivity to fuel-air composition.

Based on the above discussion, it should be appreciated that controlling ignition timing to its instantaneous optimum, subject to constraints such as knock and $NO_x$ production, will result in improved engine efficiency, and eliminates effective spark scatter due to mismatch between air-fuel ratio and ignition timing. When spark scatter is reduced, ignition timing can be advanced since the $NO_x$ and knock limited optimum ignition timing is governed by the most-advanced ignition timing events. Thus, fuel efficiency is increased. Furthermore, controlling ignition timing to its instantaneous optimum can lower torque fluctuations, since ignition timing held at its optimum will not add to the torque loss caused by fuel-air composition changes. As discussed above, if lower fuel efficiency can be tolerated, torque fluctuations can be canceled by retarding ignition timing at fuel air compositions that would normally result in an increased torque (and vice versa).

It is to be understood, of course, that while the form of the invention described above constitutes the preferred embodiment of the invention, the preceding description is not intended to illustrate all possible forms thereof. It is also to be understood that the words used are words of description, rather than limitation, and that various changes may be made without departing from the spirit and scope of the invention, which should be construed according to the following claims.

We claim:

1. For use in a vehicle having an internal combustion engine including an electronic fuel and spark control module, a method of controlling ignition timing during alternating rich and lean excursions of fuel-air composition, the method comprising:

reducing spark advance instantaneously during a rich fuel-air composition excursion; and increasing spark advance instantaneously during a lean fuel-air composition excursion, the spark advance being reduced and increased such that the engine is controlled to obtain at least one of improved engine efficiency or improved vehicle driveability by reducing engine torque fluctuations associated with the alternating rich and lean fuel-air composition excursions.

2. The method of claim 1 further comprising determining an expected torque ratio change due to a fuel-air composition excursion utilizing a relationship which relates air-fuel ratio and torque ratio, so that the-engine can be controlled to improve vehicle driveability by reducing engine torque fluctuations associated with the alternating rich and lean fuel-air composition excursions.

3. The method of claim 2 further comprising determining a current torque ratio based on a current spark advance utilizing a first relationship which relates spark advance and torque ratio.

4. The method of claim 3 further comprising determining a total torque ratio, relative to MBT spark, based on the expected torque ratio change and the current torque ratio.

5. The method of claim 4 further comprising determining a spark correction from MBT spark based on the total torque ratio, utilizing a second relationship which relates spark advance and torque ratio.

6. The method of claim 5 further comprising determining a desired final spark advance utilizing MBT spark and the spark correction from MBT spark.

7. The method of claim 6 further comprising modifying the spark advance of the engine to the desired final spark advance value, thereby canceling the torque fluctuation associated with the fuel-air composition excursion.

8. The method of claim 2 wherein the relationship which relates air-fuel ratio and torque ratio is a nonlinear relationship.

9. The method of claim 3 wherein the first relationship which relates spark advance and torque ratio is a nonlinear relationship.

10. The method of claim 5 wherein the second relationship which relates spark advance and torque ratio is a nonlinear relationship.

11. For use in a vehicle having an internal combustion engine including an electronic fuel and spark control module, an apparatus for controlling ignition timing during alternating rich and lean excursions of fuel-air composition, the apparatus comprising:

means for reducing spark advance instantaneously during a rich fuel-air composition excursion; and means for increasing spark advance instantaneously during a lean fuel-air composition excursion, the spark advance being reduced and increased such that the engine is controlled to obtain at least one of improved engine efficiency or improved vehicle driveability by reducing engine torque fluctuations associated with the alternating rich and lean fuel-air composition excursions.

12. The apparatus of claim 11 further comprising means for determining an expected torque ratio change due to a fuel-air composition excursion utilizing a relationship which relates air-fuel ratio and torque ratio, so that the engine can be controlled to improve vehicle driveability by reducing engine torque fluctuations associated with the alternating rich and lean fuel-air composition excursions.

13. The method of claim 1 further comprising determining an amount of spark adjust, for use by the reducing and increasing steps, utilizing a relationship between spark and intended fuel-air composition, so that the engine can be controlled to improve engine efficiency.

14. The method of claim 13 wherein the intended fuel-air composition is intended relative air-fuel ratio.

15. The method of claim 14 wherein adjustments to spark advance by the reducing and increasing steps are in phase and coincidental with the fuel-air composition excursions.

16. The apparatus of claim 11 further comprising means for determining an amount of spark adjust, for use by the reducing and increasing steps, utilizing a relationship between spark and intended fuel-air composition, so that the engine can be controlled to improve engine efficiency.

17. The apparatus of claim 16 wherein the intended fuel-air composition is intended relative air-fuel ratio.

18. The apparatus of claim 17 wherein adjustments to spark advance by the reducing and increasing steps are in phase and coincidental with the fuel-air composition excursions.

* * * * *